US006232942B1

(12) United States Patent
Imoto et al.

(10) Patent No.: US 6,232,942 B1
(45) Date of Patent: May 15, 2001

(54) LIQUID CRYSTAL DISPLAY DEVICE

(75) Inventors: Satoshi Imoto; Heihachiro Ebihara, both of Tanashi (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 08/817,898

(22) PCT Filed: Aug. 27, 1996

(86) PCT No.: PCT/JP96/02393

§ 371 Date: Apr. 25, 1997

§ 102(e) Date: Apr. 25, 1997

(87) PCT Pub. No.: WO97/08581

PCT Pub. Date: Mar. 6, 1997

(30) Foreign Application Priority Data

Aug. 28, 1995 (JP) ..... 7-218749

(51) Int. Cl.[7] ..... G09G 3/36
(52) U.S. Cl. ..... 345/97; 345/89
(58) Field of Search ..... 345/87, 89, 95, 345/96, 97, 106; 349/174, 173

(56) References Cited

U.S. PATENT DOCUMENTS 5,367,391 * 11/1994 Johno et al. ..... 359/56
5,459,481 * 10/1995 Tanaka et al. ..... 345/95
5,559,620 * 9/1996 Tanaka et al. ..... 349/132
5,615,026 * 3/1997 Koden ..... 349/174
5,631,752 * 5/1997 Tanaka ..... 349/173

FOREIGN PATENT DOCUMENTS 4-249290 9/1992 (JP) .
6-202082 7/1994 (JP) .
406331961A * 12/1994 (JP) ..... 345/97
407311373A * 11/1995 (JP) ..... 345/97
8-054605 2/1996 (JP) .

* cited by examiner

*Primary Examiner*—Dennis-Doon Chow
*Assistant Examiner*—Amr Awad
(74) *Attorney, Agent, or Firm*—Finnegan, Henderson, Farabow, Garrett & Dunner, L.L.P.

(57) ABSTRACT

An antiferroelectric liquid crystal display device provided with means for preventing optical transmittance or the mean value of the optical transmittance from changing in a holding period tk. Thereby, the black display state thereof is stabilized. Further, the control of a gray shades display is facilitated. Moreover, linear gray scale characteristics and high contrast are provided. Thus, in the antiferroelectric liquid crystal display device having a selection period tw and the holding period tk, the optimum holding voltage (Vh), by which the optical transmittance little changes in the holding period tk, is applied to liquid crystals.

7 Claims, 14 Drawing Sheets

LIQUID CRYSTAL DISPLAY DEVICE

TECHNICAL FIELD

The present invention relates to a liquid crystal display device using an antiferroelectric liquid crystal display panel that has a plurality of columns electrodes and a plurality of row electrodes.

BACKGROUND ART

An antiferroelectric liquid crystal is stable in an antiferroelectric state when left in a condition that no voltage (zero) is applied to the liquid crystal. Hereinafter, this stable state will be referred to as a neutral state. An antiferroelectric liquid crystal panel may be configured in such a manner as to effect either a dark display or a bright display in this neutral state. Although antiferroelectric liquid crystal panels of the present invention be applied to both a dark display and a bright display, an antiferroelectric liquid crystal panel which is adapted to effect a dark display in the neutral state will be described hereinbelow.

FIG. 7 is an example of a graph illustrating the optical transmittance of an antiferroelectric liquid crystal relative to a voltage applied thereto. In this graph, the axis of abscissa represents the applied voltages; and the axis of ordinates represents the optical transmittances.

When applying a positive voltage to the crystal, which has been in the neutral state at a point O, and increasing the positive voltage, the transmittance abruptly increases at a voltage Ft. Then, the transmittance reaches nearly the maximum value at a voltage Fs and the crystal is put into a saturated ferroelectric state. Thence, the optical transmittance does not change much even when a higher voltage is applied thereto. Next, when the applied voltage is gradually decreased, the optical transmittance abruptly drops at a voltage At. Further, the transmittance nearly reaches zero at the voltage As, and the crystal returns to an antiferroelectric state. Similarly, if a negative voltage is applied to the crystal from the voltage 0, the transmittance abruptly rises at a voltage (−Ft). Then, the transmittance nearly reaches the maximum value at a voltage (−Fs), and the crystal is put into a saturated ferrorelectric state. Thence, when the applied negative voltage is gradually reduced to 0 V, the transmittance abruptly drops at a voltage (−At). Further, the transmittance becomes almost zero at a voltage (−As), and the crystal returns to the antiferroelectric state. As above described, there are two ferroelectric states of the liquid crystal. Namely, one is the application of the positive voltage, and the other is the application of the negative voltage. Hereunder, the ferroelectric state due to the former case will be referred to as (+) ferroelectric state, while the ferroelectric state due to the latter case will be referred to as (−) ferroelectric state. Further, |Ft| designates a ferroelectric threshold voltage; |Fs| a ferroelectric saturation voltage; |At| designates an antiferroelectric threshold voltage; and |As| an antiferroelectric saturation voltage.

Generally, it is the case that the curves (namely, hysteresis curves) of FIG. 7 representing the optical transmittance characteristics of a liquid crystal relative to the voltage applied thereto are obtained by applying thereto a triangular-wave-like voltage in which the absolute value of the ratio of a change in this voltage relative to time, namely, the value of |dV/dt| is constant. However, in this case, if the value of |dV/dt| is changed, the shapes of the hysteresis curves also change. Moreover, the values of the aforementioned values As, Ft, Fs and At also vary. It is, accordingly, necessary to specify these values to specify the aforesaid value of |dV/dt|.

However, the inventor obtained FIG. 7 by the following method (hereunder referred to as a time fixation method 1) so as to obtain values more corresponding to actual driving conditions.

It is assumed that the duration of one frame (to be described later) of a display device to be used in a working temperature, is Pt and that the length of a time period, in which a selection voltage (to be described later) is applied, is Wt.

(1) A pulse voltage, whose duration is Wt and voltage level is Vx, is applied to the liquid crystal that is in a stable antiferroelectric state (namely, in the neutral state). Further, the relationship between the optical transmittance and the pulse voltage Vx at the time of completion of the application of this pulse voltage is plotted. Moreover, this operation is repeated by changing the value of the voltage Vx. Thereby, the curve drawn from the point O to Fs through Ft of FIG. 7, as well as the curve drawn from the point O to (−Fs) through the (−Ft), is obtained.

(2) Next, the liquid crystal is first put into the saturated ferroelectric state by applying thereto a voltage which is not lower than the aforementioned voltage |Fs|. Then, at a moment 0, the applied voltage is reduced to |Vz|. Thence, after the elapse of the assumed relaxation period (to be described later), the relationship between the value of the optical transmittance and the applied voltage Vz is plotted. This operation is repeated by changing the value of the voltage |vz|. Thereby, the curve drawn from Fs to the point O through At and As of FIG. 7, as well as the curve drawn from (−Fs) to the point O through (−At) and (−As), is obtained.

When some liquid crystal panels are used, the curve (namely, the curve drawn from Fs or (−Fs) to the point O in FIG. 7) obtained in the aforementioned case (2) sometimes intersects the ordinate axis. The main cause of this is the responsivity of the liquid crystal. Namely, in the case that the liquid crystal is maintained in the ferroelectric state by applying thereto a voltage, which is not lower than the aforementioned voltage |Fs|, and that at the moment 0, the applied voltage Vz is changed into 0, the liquid crystal finally becomes stable in the antiferroelectric state after the elapse of a certain time period (hereunder referred to as a relaxation time tn). However, if this relaxation time tn is longer than the relaxation period (to be described later), the curve obtained in the aforementioned case (2) intersects the ordinate axis.

When actually driven, it is difficult to bring such a liquid crystal panel into a complete antiferroelectric state, and a dark display cannot be effected and that the contrast is extremely degraded.

Generally, a liquid crystal panel is driven by performing the following process. Namely, first, N row electrodes and M column electrodes are formed in such a manner as to be arranged as a matrix of N rows and M columns. Further, a scanning signal is applied to each of the row electrodes through a row-electrode drive circuit, while a display signal depending on display data of each pixel (incidentally, a part of the display signal is sometimes not dependent on the display data) is applied to each of the column electrodes through a column-electrode drive circuit. Moreover, a voltage (hereunder referred to simply as a synthesis voltage), which corresponds to the difference between the scanning signal and the display signal, is applied to a liquid crystal layer. The time period required to scan all of the row electrodes (namely, 1 vertical scanning interval) is usually referred to as 1 frame (or 1 field). In the case of driving the liquid crystal panel, the polarity of a driving voltage is reversed or inverted each frame (or every frames) in order to prevent the liquid crystal from being adversely affected (for example, the degradation due to non-uniform distribution of ions).

FIG. 9 illustrates the waveforms of signals flowing through the row electrodes, the column electrodes and the pixel synthesis electrodes of a liquid crystal panel in which the N row electrodes and the M column electrodes are formed in such a manner as to be arranged as a matrix of N rows and M columns. The display conditions or states of pixels are assumed as follows. Namely, in the case of a first column (Y1), pixels in all rows are displayed in white. Further, in the case of a second column (Y2), a pixel in a first row is displayed in black, and pixels in the other rows are displayed in white. Moreover, in the case of pixels in a third column (Y3), these pixels are displayed alternately in black and in white. Furthermore, in the case of an Mth column, Ym pixels are displayed in black in all rows.

Waveforms of scanning signals are respectively applied to the N row electrodes in sequence from the top row to the bottom row so that each of the waveforms is shifted by a time (1/N). Waveforms of display signals applied to the M column electrodes are synchronized with the scanning signal and the waveforms according to whether the pixels are displayed in white or in black are applied.

Paying attention to a synthesis voltage applied to each pixel, with respect to P11 displayed in white and P12 displayed in black in the first row, the voltage applied to P11 in the selection period tw, which is displayed in white, is a large waveform, whereas the voltage applied to P12 in the selection period tw, which is displayed in black is a small waveform. The synthesis voltage applied to a pixel P21, which is displayed in white in a second row, has a waveform which is almost the same as obtained by shifting the waveform of the synthesis voltage applied to the pixel P11 by (1/N). Here, note that the first and the second frame in the first row and the second row are shifted with respect to each other by (1/N).

Turning attention to the scanning signal to be applied to a single row electrode, 1 vertical scanning interval is composed of N horizontal scanning intervals (in some case, an additional interval is added thereto). Among a horizontal scanning interval, a part of horizontal scanning interval in which a scanning voltage (hereunder referred to as the selection voltage) to be used for determining the display condition of a pixel on this row is applied, is referred to as a selection period tw. The other part of horizontal scanning interval are referred to as non-selection periods.

Usually, in the case of the antiferroelectric liquid crystal panel, it is determined on the basis of the aforementioned display signal at the time of applying the selection voltage whether the state of the liquid crystal, which has been in the antiferroelectric state, is maintained or is changed into the ferroelectric state. Thus, there is the necessity of a time period (hereunder referred to as a relaxation period ts) required for setting the liquid crystals in the antiferroelectric state before the application of the selection voltage. During a time period which is other than the selection period tw and the relaxation period ts, the determined state of the liquid crystal should be held. Hereunder, this time period will be referred to as a holding period tk.

FIG. 10 illustrates the waveforms of a scanning signal waveform (Pa) applied to a given pixel of interest, display signal waveforms (Pb, Pb'), synthetic signal waveforms (Pc, Pc') and optical transmittances L100 and L0 according to the driving method described in FIGS. 1 and 2 of the Japanese Unexamined Patent Publication (Kokai) No. 4-362990/1992.

In FIG. 10, F1 and F2 designate the first frame and the second frame, respectively. This figure illustrates the case where the polarity of the aforementioned driving voltage is inverted every frame. As is apparent from this figure, the first frame F1 is different from the second frame F2 only in that the polarity of the driving voltage is inverted. As is obvious from the aforementioned FIG. 7, an operation of the liquid crystal display device is symmetric with respect to the polarity of the driving voltage. Therefore, the following description will be given regarding only the first frame, except in case of necessity.

Further, in the following description and drawings of the waveform of driving signals, the electric potential indicated as "0" does not mean absolute electric potential but means the reference electric potential. Therefore, in the case that the reference electric potential varies for some reason, scanning signals and display signals vary relatively. Moreover, in the case that the word "voltage" is used in connection with the scanning signals and the display signals in the following description, the word "voltage" designates the difference between the electric potential indicated by such a signal and the reference electric potential.

Incidentally, the value of each of the aforementioned ferroelectric threshold voltage |Ft|, the aforementioned ferroelectric saturation voltage |Fs|, the aforementioned antiferroelectric threshold voltage |At| and the aforementioned antiferroelectric saturation voltage |As| in the (+) ferroelectric side is sometimes slightly different from the value thereof in the (−) ferroelectric side. However, for simplicity of description, the following description will be presented by assuming that each of these voltage has the same value.

As shown in FIG. 10, 1 frame is divided into three time periods, namely, the selection period tw, the holding period tk and the relaxation period ts. The selection period tw is further divided into time periods tw1 and tw2, which have equal lengths. The voltage level of a scanning signal Pa in the first frame F1 is set as follows. Needless to say, in the second frame F2, the polarity of the voltage is inverted. Here, note that ±V designates the selection voltage and that the length of the time period tw2 corresponds to the aforementioned Wt.

| Time Period | tw1 | tw2 | tk | ts |
|---|---|---|---|---|
| Scanning Signal Voltage | 0 | +V1 | +V3 | 0 |

Further, the display signal is set as follows according to the display state. Here, note that the symbol "*" indicates that the voltage depends on the display data of other pixels in a same column as this pixel.

| Time Period | tw1 | tw2 | tk | ts |
|---|---|---|---|---|
| On-State Display Signal Voltage | +V2 | −V2 | * | * |
| Off-State Display Signal Voltage | −V2 | +V2 | * | * |

In the case of the hysteresis curves of FIG. 7, generally, the curve drawn from As to Ft or from At to Fs is not flat. Thus, when the voltage applied to the liquid crystal in the holding period tk is shifted depending on the display signal, a change in the brightness in this holding period is caused. To prevent an occurrence of this phenomenon, usually, the polarity of the display signal is inverted in such a manner that the average value thereof in a horizontal scanning interval is 0. Namely, the polarity of the display signal in the time period tw1 is changed in the time period tw2.

In FIG. 10, Pb, Pc and L100 respectively denote the waveform of a display signal, that of a synthetic signal and optical transmittance in the case that all of the pixels provided on a column electrode, to which a pixel of interest belongs, are in an on-state (a bright state). In this case, if the (synthetic) voltage to be applied to the liquid crystal in the time period tw2 meets the following condition: $|V1+V2|>|Ft|$ (see FIG. 7), the transition of the state of the liquid crystal into the ferroelectric state is started. As a result, the optical transmittance of the liquid crystal increases. In the holding period tk, if the following condition is satisfied: $|V3-V2|>|At|$, the bright state is held. In the relaxation period ts, if the following condition is satisfied: $|V2|<|As|$, the transmittance decreases with the elapse of time. Thus, the relaxation of the liquid crystal, namely, the change of the state thereof from the ferroelectric state to the stable antiferroelectric state is expected to occur.

Further, in FIG. 10, Pb', Pc' and L0 respectively designate the waveform of a display signal, that of a synthetic signal and optical transmittance in the case that all of the pixels provided on a column electrode, to which a pixel of interest belongs, are in an off-state (a dark state). In this case, if the synthetic voltage to be applied to the liquid crystal in the time period tw2 meets the following condition: $|V1-V2|<|Ft|$, the voltage applied in the holding period tk meets the following condition: $|V3+V2|<|Ft|$, and the voltage applied in the relaxation period ts meets the following condition: $|V2|<|Ft|$, it can be expected that the dark state is caused.

It is, however, found that as indicated by dashed line in the dark state L0 of FIG. 10, even if the voltage applied during the holding period tk meets the condition: $|V3+V2|<|Ft|$, the mean value of the optical transmittance gradually increases and thus, black display become unable to be presented, and that consequently, the contrast is sometimes degraded. It is further known that this phenomenon occurs in the case when the voltage applied in the time period tw2 has a value between $|Ft|$ and $|Fs|$, namely, in the case when halftone gray scale are displayed. Therefore, it is found that this phenomenon results not only in deterioration in the contrast but also in gradual increase in the mean value of the optical transmittance during the holding period tk even in the case of displaying halftone gray scale and that there is caused a serious problem in that a linear-gray shades display cannot be obtained.

DISCLOSURE OF INVENTION

Accordingly, a problem to be solved by the present invention is to provide an antiferroelectric liquid crystal display device that institutes measures for preventing an occurrence of a change in the mean value of the optical transmittance of liquid crystals during the holding time period tk, thereby stabilizing a black display state and facilitating a gray shades display control operation and realizing a high-contrast with linear-gray scale display characteristic.

The inventor investigated the influence of the voltage (hereunder referred to as a holding voltage) applied to the liquid crystals in the holding period tk during the halftone gray scale display. This investigation revealed that there was a holding voltage (hereunder referred to as an optimum holding voltage Vh), at which almost no change occurs in the optical transmittance during the holding period tk, between aforementioned At and Ft.

Namely, referring to in FIG. 11(*a*), Pt denotes the length of one frame employed in a display device to be checked; and Wt the length of a time period during which a selection voltage is applied. Further, a pulse voltage, which has a duration Wt and further has an arbitrary voltage value $|Vx|$ between $|Ft|$ and $|Fs|$, is applied to a liquid crystal, which is in a stable antiferroelectric state (in the neutral state). Upon completion of application of this pulse voltage, the applied voltage is reduced to a voltage value $|Vz|$. Then, a change in optical transmittance during the time period Pt is drawn in this figure.

FIG. 11(*b*) illustrates a change in the optical transmittance in the case that the voltage value $|Vx|$ is fixed but the voltage value $|Vz|$ is changed. As is apparent from FIG. 11(*b*), the optical transmittance is almost constant in a time period (Pt−Wt) in the case that $|Vz|=|Vh|$. Further, in the case that the value $|Vz|$ is larger than the value $|Vh|$, the optical transmittance gradually increases in the time period (Pt−Wt). it is understood that this phenomenon was observed in the conventional device as a problem thereof. Furthermore, in the case that the value $|Vz|$ is smaller than the value $|Vh|$, the optical transmittance gradually decreases in the time period (Pt−Wt).

Next, FIG. 11(*c*) illustrates a change in the optical transmittance in the case that the voltage value $|Vz|$ is set at the optimum holding voltage $|Vh|$, which is obtained in the case of FIG. 11(*b*), and that the voltage value $|Vx|$ is changed. In the case of this example, the optical transmittance is nearly constant during the time period (Pt−Wt), regardless of the value $|Vx|$.

Moreover, the curves (the hysteresis curves) of FIG. 7 representing the optical-transmittance characteristics are obtained by the time fixation method 1. However, in a part of the curve, in which the optical transmittance steeply increases, of FIG. 7, the optical transmittance does not increase at a stretch. Namely, in a leading portion of such a part of the curve, the optical transmittance somewhat gently increases. Thus, the value of the ferroelectric threshold voltage $|Ft|$ is not definitely determined as a specified value. Hence, when the value of a voltage to be applied for a halftone gray shades display is found according to the characteristics obtained by the time fixation method 1 and the halftone gray scale is displayed, the difference between the gray scale obtained in the case of applying a voltage (for example, Ft) for displaying black and the gray scale obtained in the case of applying a voltage (for example, Ft+Δ) for displaying a halftone gray scale is less than expected. Accordingly, another problem to be solved by the present invention is to provide a hysteresis curve by which an expected gray scale can be obtained, even when the halftone gray scale is displayed.

To solve the problems, the following measures are taken by the present invention in an antiferroelectric liquid crystal device having a holding period tk.

The first measure taken by the present invention so as to solve the problems is to set a scanning signal voltage, which is applied during a holding period tk, at a voltage value at which the optical transmittance is maintained at a nearly constant value when a display signal voltage is made to be 0 in this holding period tk.

The second measure taken by the present invention so as to solve the problems is to set a scanning signal voltage, which is applied during a holding period tk, at a voltage value at which the optical transmittance is maintained at a nearly constant value when a display signal voltage is not 0 in this holding period tk.

The third measure taken by the present invention so as to solve the problems is to cause a scanning signal voltage, which is applied at least during a holding period tk, to vary in response to a change in temperature.

The fourth measure taken by the present invention so as to solve the problems is to obtain a method for obtaining a hysteresis curve being capable of providing expected gray scale in the case of displaying a halftone gray scale, by using an optimum holding voltage.

ADVANTAGES OF INVENTION

By using the aforementioned measures, variation in the mean value of the optical transmittance in the holding period tk can be controlled. Thus, an occurrence of a phenomenon, in which the optical transmittance gradually increases in the dark state and thereby the contrast is deteriorated in the dark state, can be prevented. Moreover, the gray scale control in the entire frame is facilitated and a linear gray shade display is obtained. Consequently, a high-contrast antiferroelectric liquid crystal display device, which has good gradational display performance, can be provided.

Furthermore, as a result of making necessary temperature compensation for the optimum holding voltage Vh, the optical transmittance can be maintained at a constant value during the holding period tk, irrespective of temperature.

Additionally, a hysteresis curve, which is equivalent to a gray scale in an actual drive of the liquid crystal display device, can be obtained. Thus, the gradational display can be easily achieved.

DETAILED DESCRIPTION OF INVENTION

Hereinafter, embodiments of the present invention will be described in detail by referring to the accompanying drawings. Further, the following description will be given regarding only the first frame, unless descriptions concerning the second frame, which is different from the first frame only in the polarity of applied voltages, are necessary.

Incidentally, the value |Vh| in the (+) ferroelectric side is sometimes slightly different from the value thereof in the (−) ferroelectric side. However, for simplicity of description, the following description will be presented by assuming that each of these voltage has the same value in the (+) ferroelectric side and the (−) ferroelectric side.

Figure 1:
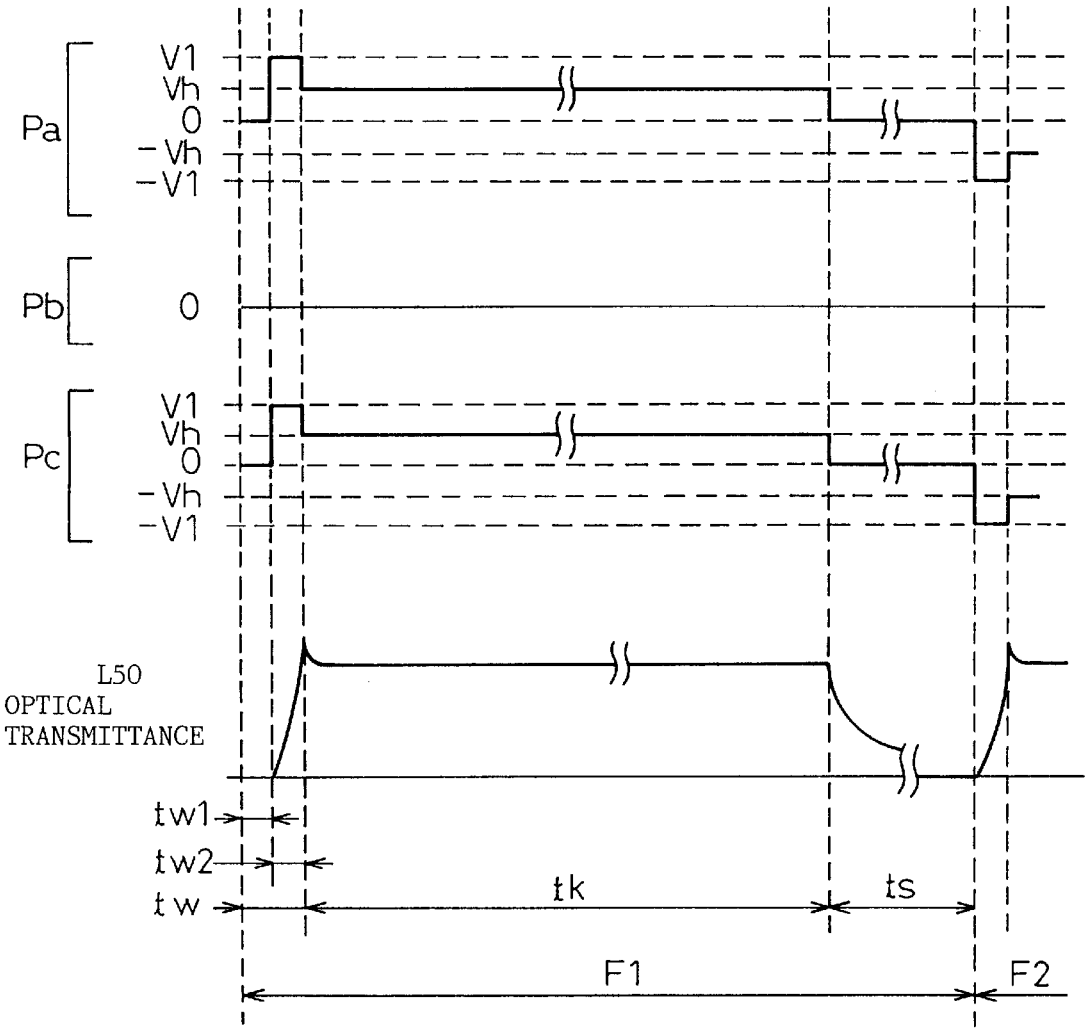
FIG. 1 is a diagram showing driving waveforms and optical transmittance for illustrating a first embodiment of the present invention.

FIG. 1 illustrates the driving waveforms concerning pixels of interest and further illustrates change in the optical transmittance in the case of the first embodiment of the present invention. Further, FIG. 1 is a diagram showing the waveform (Pa) of a scanning signal, the waveform (Pb) of a display signal, the waveform (Pc) of a synthesis voltage to be applied to a given pixel of interest, and the optical transmittance L50. Moreover, FIG. 1 illustrates the case that the aforementioned first measure was performed when all pixels on a column electrode, to which the pixel of interest belongs, are in a halftone gray scale state. In this case, this embodiment obtained gray scale levels by performing an amplitude modulation method. Here, when tw1 and tw2 denote a first half and a second half of the selection period tw, respectively, the voltage level, which is represented by each signal in the time periods tw1, tw2, the holding period tk and the relaxation period ts in the first frame, is as listed hereinbelow.

| Time Period | tw1 | tw2 | tk | ts |
|---|---|---|---|---|
| Scanning Signal Voltage | 0 | +V1 | +Vh | 0 |
| Display Signal Voltage | 0 | 0 | 0 | 0 |

The optimum holding voltage Vh has a value between At and Ft, as above described. The display signal voltage is 0.

In the case of the above embodiment, V1=20 V, Vh=7.2 V.

The voltage applied to liquid crystals in the time period two in the first frame of FIG. 1 is 0 V. Further, the optical transmittance is 0. In the time period tw2, the voltage V1 is applied thereto, and the optical transmittance is 50%. In the holding period tk, the voltage Vh is applied thereto, and the optical transmittance is maintained at 50%.

Figure 2A:
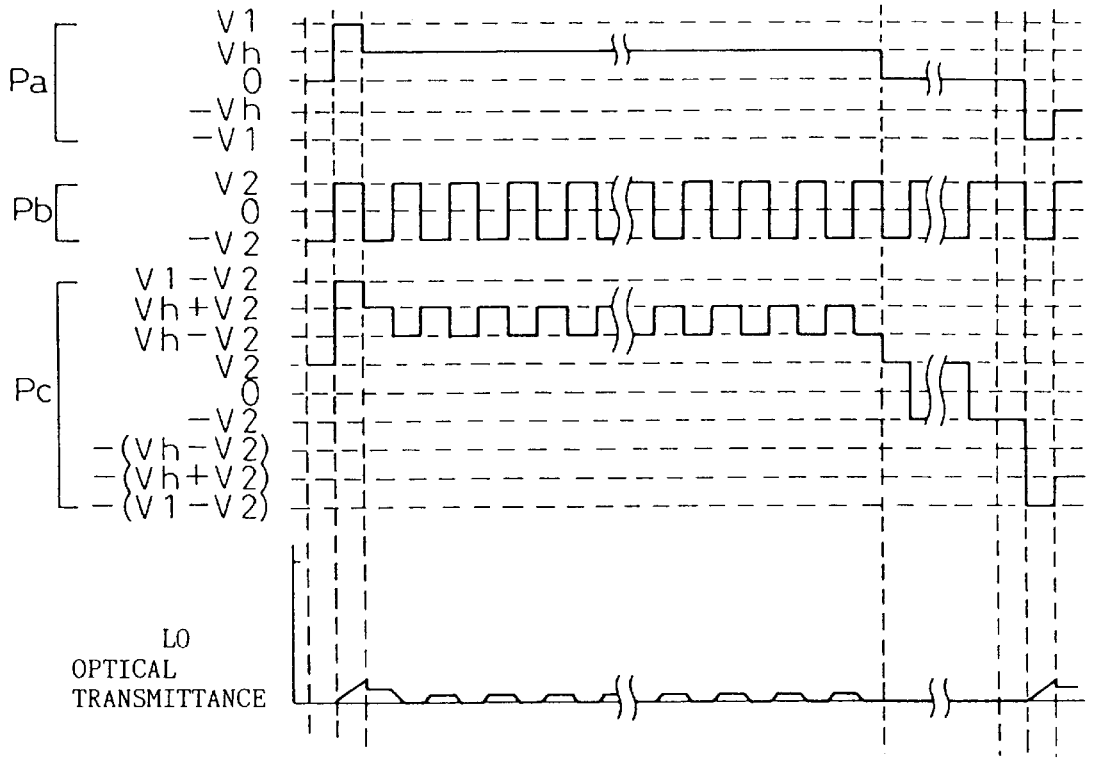
FIG. 2 is a diagram showing driving waveforms and optical transmittance for illustrating a second embodiment of the present invention.
Figure 2B:
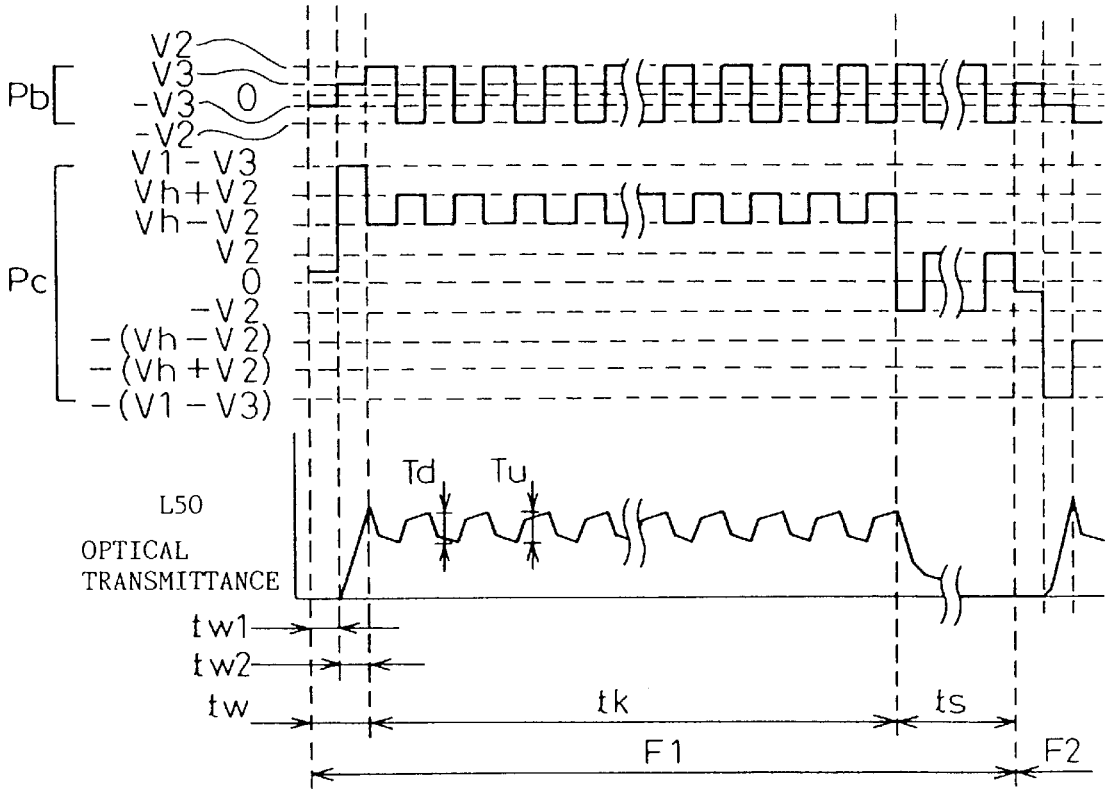
Figure 3A:
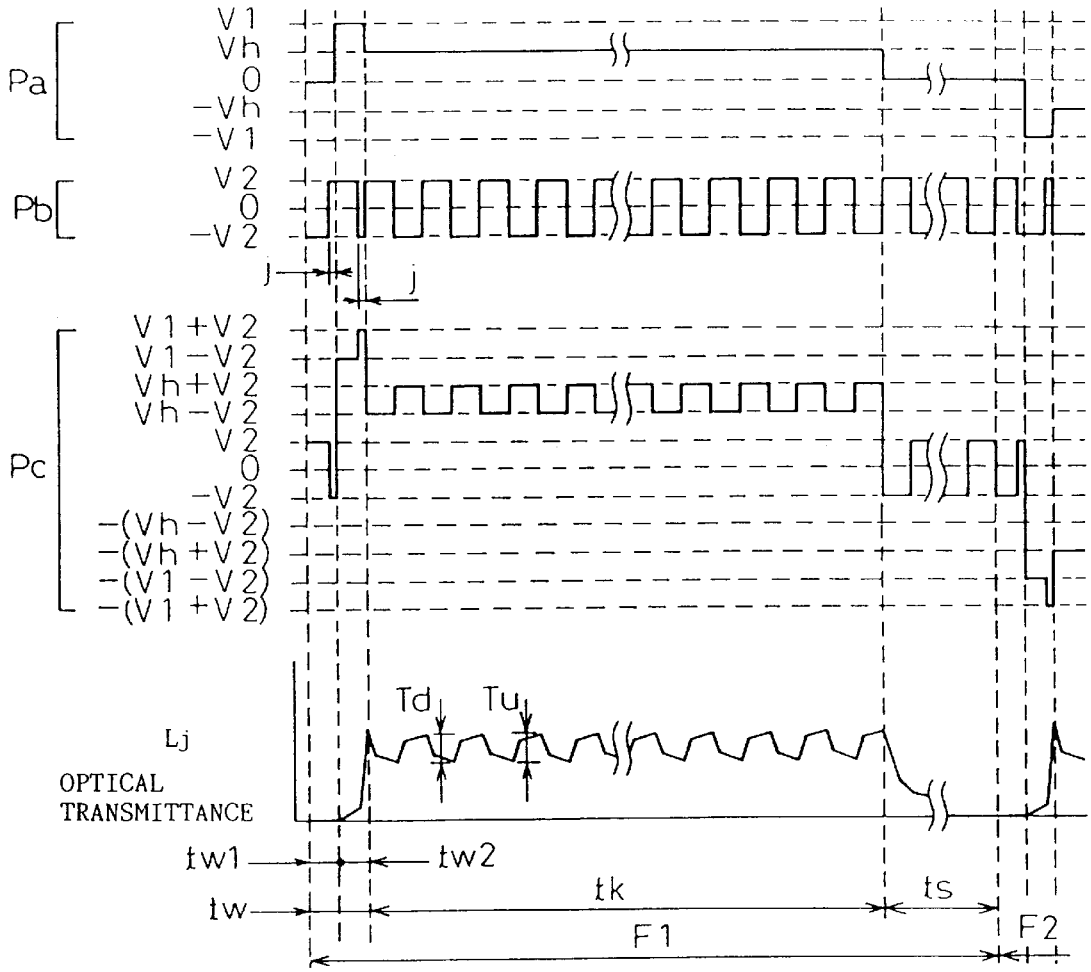
FIG. 3 is a diagram showing driving waveforms and optical transmittance for illustrating a third embodiment of the present invention.
Figure 3B:
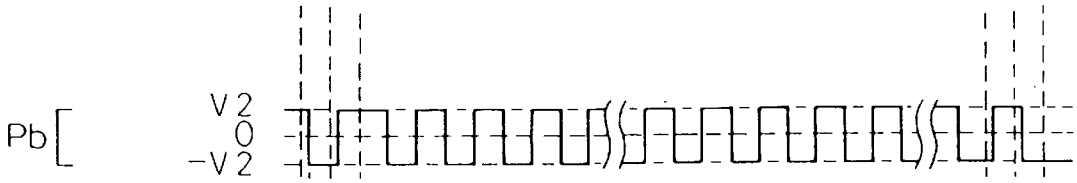
Figure 3C:
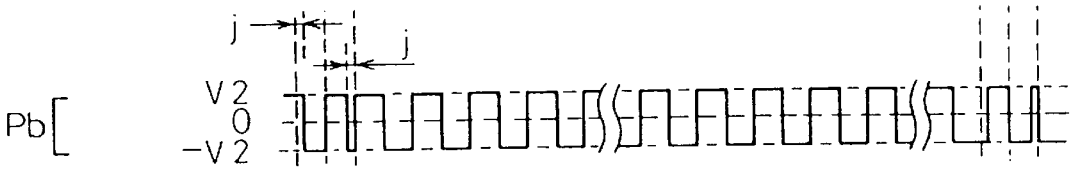
Figure 3D:
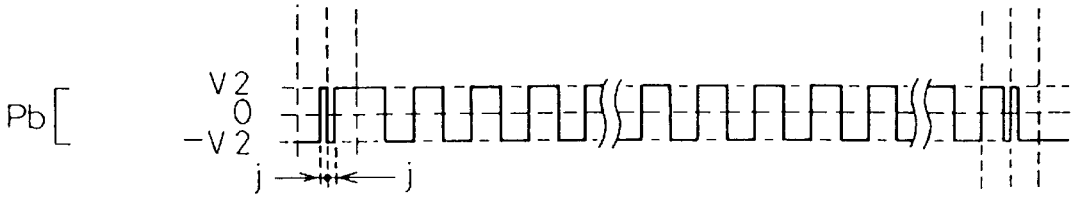

FIG. 2 is a diagram illustrating the driving waveform concerning a pixel of interest and further illustrates change in the optical transmittance in the case of the second embodiment of the present invention. FIG. 2(*a*) illustrates the case that the aforementioned second measure is performed when all pixels on a column electrode, to which the pixel of interest belongs, are in a dark state. In this case, when tw1 and tw2 denote a first half and a second half of the selection period tw, respectively, the voltage level, which is represented by each signal in the time periods tw1, tw2, the holding period tk and the relaxation period ts in the first frame F1, is as listed hereinbelow.

| Time Period | tw1 | tw2 | tk | ts |
|---|---|---|---|---|
| Scanning Signal Voltage | 0 | +V1 | +Vh | 0 |
| Display Signal Voltage | −V2 | +V2 | * | * |

Incidentally, the voltage of the display signal is set in such a manner that $|Vh+V2|<|Ft|$. In the case of the liquid crystal panel used in this embodiment, the value Vh is closed to the value At. As a result, the following inequality holds: $|Vh-V2|<|At|$.

In the case of this embodiment, V1=22 V, v2=5 V, and Vh=7.2 V.

The voltage applied to liquid crystals in the time period tw1 in the first frame of FIG. 2(*a*) is V2. However, almost no change is caused in the optical transmittance. In the time period tw2, the voltage (V1−V2) is applied thereto, and the optical transmittance is slightly increased. Furthermore, in the holding period tk, the voltages (Vh+V2) and (Vh−V2) are alternately applied thereto. Although a change in the optical transmittance due to this variation in the applied voltage is observed, the amount of variation in the optical transmittance is decreased by an amount by which the set value of the scanning voltage in the holding period tk is lower than that of the scanning voltage in the conventional device. Further, the increase in the mean value of the optical transmittance, which causes problems, is not observed. It is thus confirmed that the present invention is effective.

FIG. 2(*b*) illustrates, in the second measure taken by the present invention, the driving waveforms and the optical transmittance L50 in the case that the pixel of interest is in the gray shade display state between the bright state and the dark state and the other pixels on a column electrode, to which the pixel of interest belongs, are bright. Generally, when performing the gray shades display, there are two methods, namely, a method (amplitude modulation method), by which the gray shade display is performed by changing the magnitude of the display signal voltage and further changing the magnitude (V1+V2) of the voltage applied to the liquid crystals, and the other method (pulse-width modulation method) by which the gray shades display is performed by changing the length of a time period, during which the voltage (V1+V2) is applied to the liquid crystal, without changing the magnitude or value of the voltage (V1+V2). FIG. 2(*b*) illustrates the case that each of the signal voltages is set by the amplitude modulation method in the time periods tw1 and tw2, the holding period tk and the relaxation period ts of the first frame F1, as listed hereinbelow.

| Time Period | tw1 | tw2 | tk | ts |
|---|---|---|---|---|
| Scanning Signal Voltage | 0 | +V1 | +Vh | 0 |
| Display Signal Voltage | −V3 | +V3 | * | * |

In the case of the hereinabove-mentioned embodiment, V3=2 V. Incidentally, the values of the voltages V1, V2 and Vh are equal to those of these voltages in the case of FIG. 2(*a*).

In the time period tw1 of the selection period tw, the liquid crystal is maintained in the antiferroelectric state. When the voltage (V1−V3) is applied in the time period tw2, the transition of the state of the liquid crystal into the (+) antiferroelectric state is commenced. Immediately after the expiration of this period tw2, the liquid crystal is put into the halftone gray scale state. When the voltage (Vh−V2) is applied to the liquid crystal in the holding period tk, the optical transmittance is dropped. In contrast, when the voltage (Vh+V2) is applied to the liquid crystal in the holding period tk, the optical transmittance rose. However, these variations in the optical transmittance due to the change in the applied voltage are canceled. Thus the mean value of the optical transmittance does not substantially change. Next, when the voltages V2 or (−V2) is applied in the relaxation period ts, the state of the liquid crystal is changed from the ferroelectric state to the antiferroelectric state and becomes stable.

Namely, as is apparent from L50 of FIG. 2(*b*), even in the case that the halftone gray scale is displayed, according to the second measure of the present invention, a phenomenon that the mean value of the optical transmittance considerably rose in the holding period tk is not observed as in the conventional device. It is found that the present invention was extremely effective.

Actually, pixels other than the pixel of interest on the same column electrode show various displays. Thus the manner of the voltage applied to the pixel of interest in the holding period tk is more complex than the manner in the case of FIG. 2(*b*). Even in such a case, the present invention still has advantages.

FIG. 3 illustrates a third embodiment of the present invention and shows the driving waveform and the optical transmittance in the case of the performing the gray shades display by utilizing the pulse width modulation. Incidentally, it is assumed that all of the pixels other than a pixel of interest on a same column electrode are in the bright state. In the case illustrated by FIG. 3(*a*), it is assumed that the display signal voltage in the selection period tw of the first frame is (−V2) in (tw1−j) which is a leading part of the period tw1, and V2 in j which is the remaining part of the period tw1, that the display signal voltage is V2 in (tw2−j) which is a leading part of the period tw2, and (−V2) in j which is the remaining part of the period tw2. Namely, in the time period tw2, a time period, in which the voltage (V1+V2) is applied to the liquid crystal, is j which is the time period. Thus, the gray scale is displayed by controlling each of the voltages and changing the length j in such a manner that the liquid crystal is in the dark state when j=0 and that the liquid crystal is in the bright state when j=tw2. As is seen from Lj in FIG. 3(*a*), no variation in the mean value of the optical transmittance in the holding period tk is observed in this case.

In the case of this embodiment, V1=22 V, V2=5 V and Vh=7.2 V.

FIGS. 3(*b*), 3(*c*) and 3(*d*) are waveform charts for illustrating other modes of the pulse width modulation method. FIG. 3(*b*) illustrates the case that the display signal voltage in the selection period tw of the first frame is V2 in j which is a leading part of the period tw1, and (−V2) in (tw1−j) which is the remaining part of the period tw1, that the display signal voltage in the selection period tw of the first frame is (−V2) in j which is a leading part of the period tw2, and V2 in (tw2−j) which is the remaining part of the period tw2. The difference between the modes of the pulse width modulation method as illustrated by FIGS. 3(*a*) and 3(*b*) can be regarded as resulting from the shift in phase of the display signal voltage in the period tw.

FIG. 3(*c*) illustrates the case that the display signal voltage in the selection period tw of the first frame is V2 in j which is a leading part of the selection period tw1, and (−V2) in (tw1−j) which is the remaining part of the period tw1, that the display signal voltage in the selection period tw of the first frame is V2 in (tw2−j) which is a leading part of the period tw2, and (−V2) in j which is the remaining part of the period tw2. FIG. 3(*d*) illustrates the case that the display signal voltage in the selection period tw of the first frame is (−V2) in (tw1−j) which is a leading part of the period tw1, and V2 in j which is the remaining part of the period tw1, that the display signal voltage in the selection period tw of the first frame is (−V2) in j which is a leading part of the period tw2, and V2 in (tw2−j) which is the remaining part of the period tw2.

In the cases of FIGS. 3(*b*) to 3(*d*), nearly the same results as of FIG. 3(*a*) are obtained in the holding period tk.

Even in the case that the gray shades display is performed by utilizing the pulse width modulation, pixels other than the pixel of interest on the same column electrode show various display. Thus, the voltage applied to the pixel of interest in the holding period tk is more complex than the manner in the case of FIG. 3(*a*). Even in such a case, the present invention still has advantages.

Figure 11A:
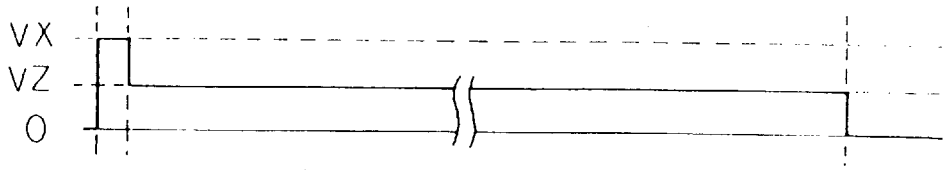
FIG. 11 is a graph illustrating a change in the optical transmitter versus the holding voltage of the antiferroelectric liquid crystal panel.
Figure 11B:
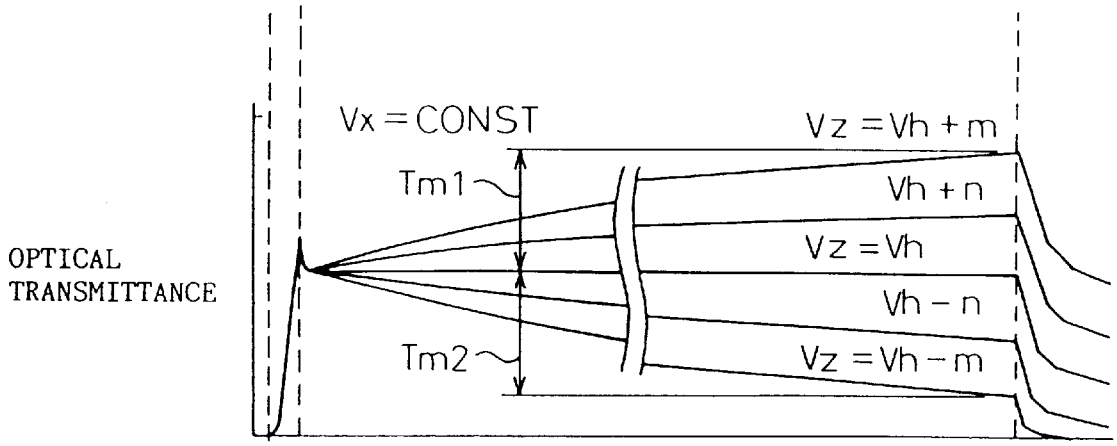
Figure 11C:
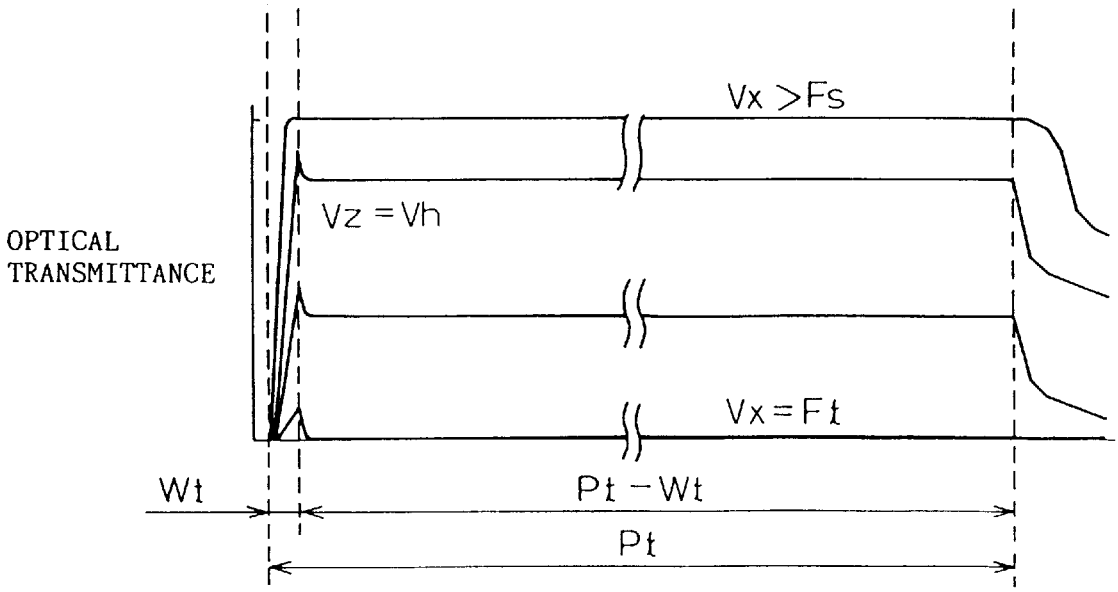

Meanwhile, referring now to FIG. 11(*b*), an amount Tm1 of change in the optical transmittance in the case that (Vz=Vh+m) is not always equal to an amount Tm2 of change in the optical transmittance in the case that (Vz=Vh−m). Further, the aforementioned fast response to the change in the applied voltage at the time of increase in the optical transmittance is sometimes slightly different from the fast response to the change in the applied voltage at the time of decrease in the optical transmittance. Thus, in the case of FIG. 2(*b*) or FIG. 3(*a*), the amount Tu of increase in the optical transmittance is sometimes different from the amount Td of decrease of the optical transmittance. In this case, in the holding period tk, the mean value of the optical transmittance varies slightly.

Figure 4:
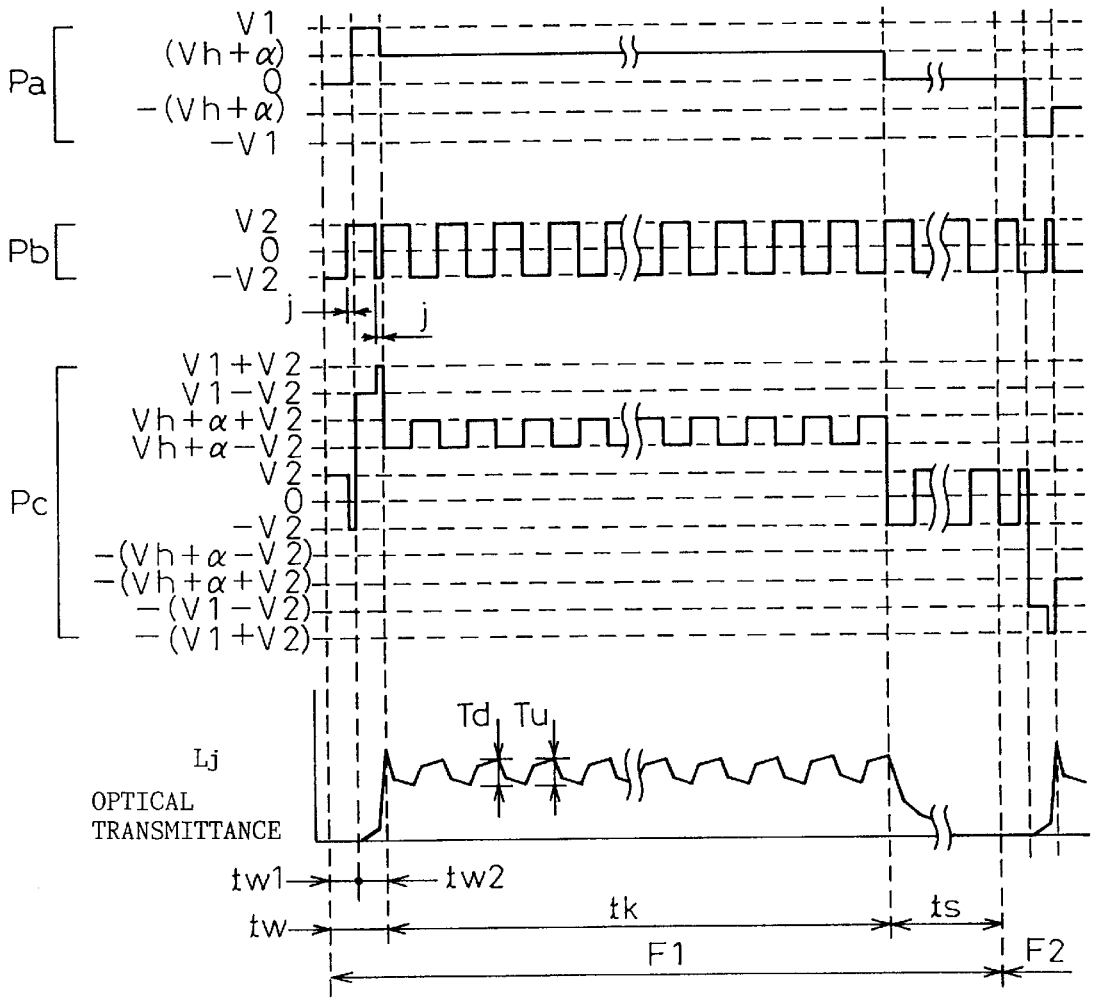
FIG. 4 is a diagram showing driving waveforms and optical transmittance for illustrating a fourth embodiment of the present invention.

FIG. 4 is a diagram showing driving waveforms and the change in optical transmittance for illustrating the fourth embodiment of the present invention, in which the second measure is performed in the case that the gray shades display is carried out by utilizing the pulse width modulation method. Namely, in FIG. 4, the scanning signal voltage is (Vh+α) in the holding period tk of the first frame, and, the scanning signal voltage is—(Vh+α) in the holding period tk of the second frame. For example, in the case that the scanning signal voltage is Vh in the holding period tk of the first frame, if the mean value of the optical transmittance in the holding period tk tends to rise, the scanning signal voltage may be set in such a way that $\alpha<0$. Moreover, for instance, in the case that the scanning signal voltage is vh in the holding period tk of the first frame, if the mean value of the optical transmittance in the holding period tk tends to drop, the scanning signal voltage may be set in such a way that $\alpha>0$. Namely, α is set in such a manner that |Td|=|Tu| in FIG. 4.

In the hereinabove-mentioned embodiment, V1=22, V2=5 V and Vh=7.2 V.

In this case, the value of the scanning signal voltage in the holding period tk is different from the optimum holding voltage Vh. However, when employing the pulse width modulation method, there is not caused the case that the voltage applied to the liquid crystal in the holding period tk is maintained at the scanning voltage in a long time at any gray scale, different from the gray shades display performed by utilizing the amplitude modulation method illustrated in FIG. 2. Moreover, the display signal is applied symmetrically to the liquid crystal with respect to the positive and negative values. Consequently, no problems are caused.

Needless to say, this second measure may be applied to the case that the gray shades display is performed by using the amplitude modulation method. However, in such a case, an amount α of correction to be added should be determined by taking the entire display performance into consideration.

Figure 5:
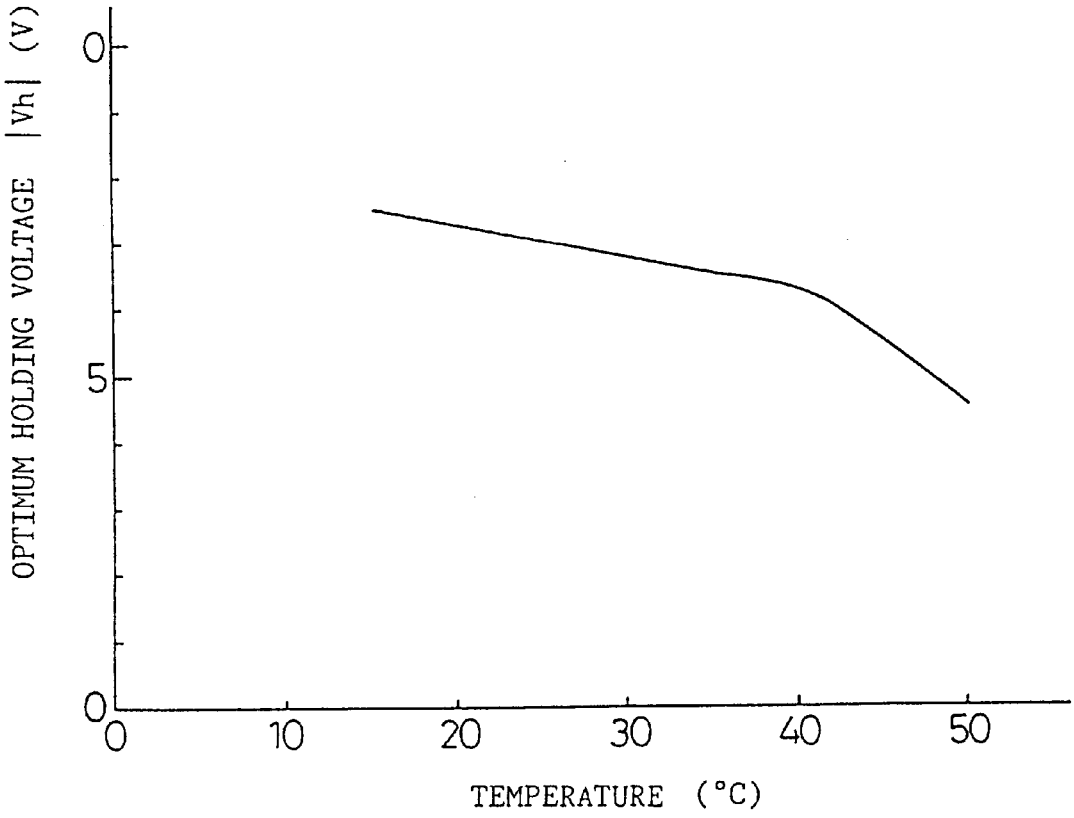
FIG. 5 is a graph illustrating the temperature characteristics of the optimum holding voltage of an antiferroelectric liquid crystal panel used in the present invention.
Figure 6A:
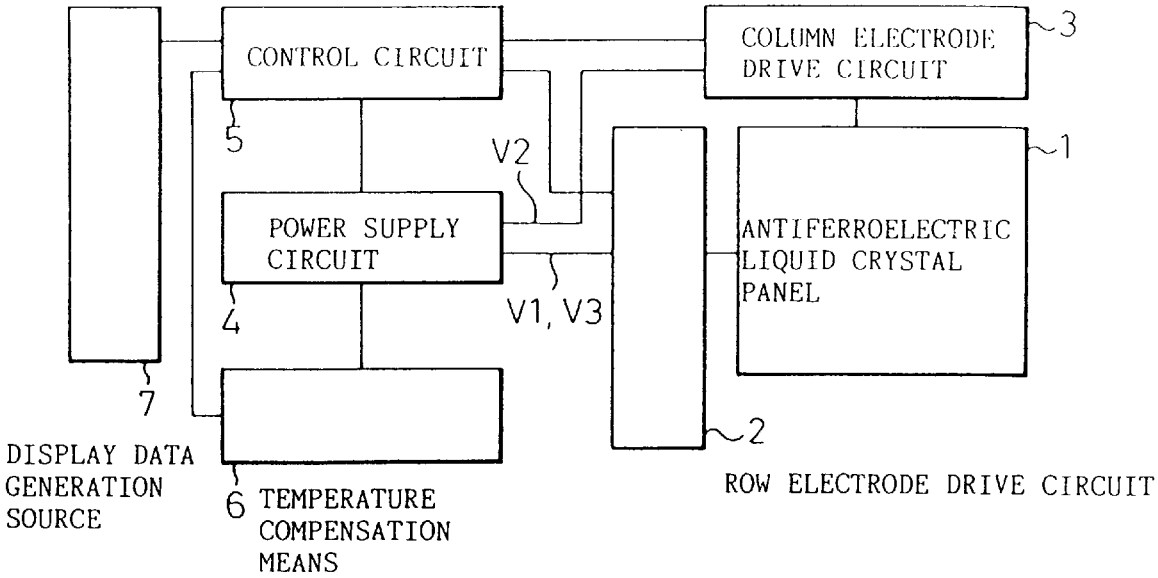
FIG. 6 is a block diagram of the circuit configuration of a fifth embodiment of the present invention and a characteristic diagram for illustrating how temperature compensation is performed therein.
Figure 6B:
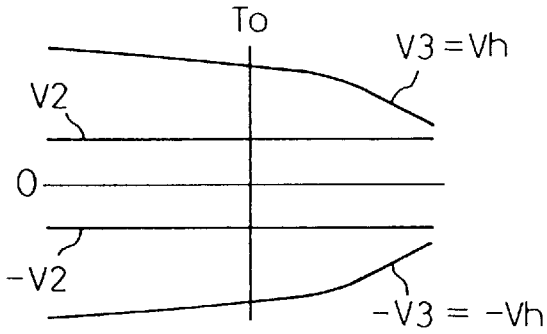
Figure 6C:
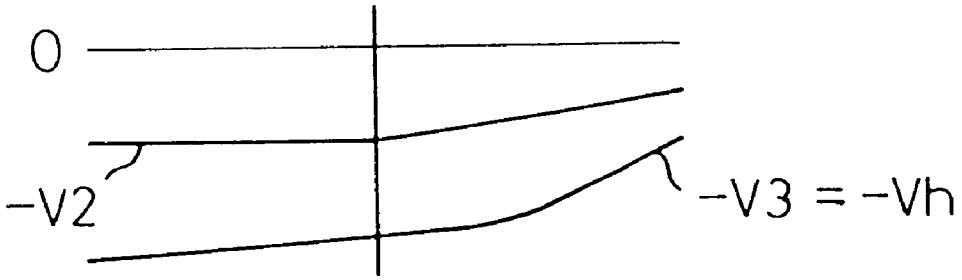
Figure 6D:
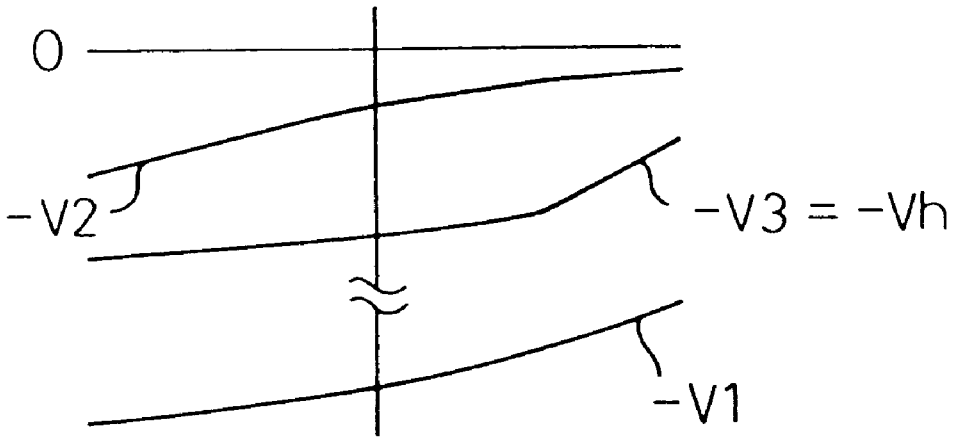

Next, in the first or second embodiment, when changing the ambient temperature, a reduction of effects of the first measure due to the change in temperature is observed. Thus, the relation between the optimum holding voltage |Vh| and temperature in the antiferroelectric liquid crystal panel used in this embodiment is investigated. It was found that, as illustrated in FIG. 5, the optimum holding voltage |Vh| is gradually decreased at temperatures between 20 and 40 degrees centigrade and, when exceeding 40 degrees centigrade, the voltage drops somewhat steeply. Variation in the optimum holding voltage |Vh| due to change in temperature results in reduction in contrast and further results in deterioration in linearity of the gray shades display.

FIG. 6 illustrates a fifth embodiment of the present invention. FIG. 6(*a*) is a block diagram showing the circuit configuration for performing the third measure. FIG. 6(*b*) is a temperature characteristic graph for illustrating an embodiment of the third measure. In FIG. 6(*a*), row electrodes, to which scanning signals of the antiferroelectric liquid crystal panel 1 are applied, are connected to a row electrode drive circuit 2. Further, column electrodes, to which display signals are applied, are connected to a column electrode circuit 3. The voltages ±V1 (the voltage applied in the selection period tw) and ±V3 (the voltage applied during the holding period tk) required to drive the row electrodes of the liquid crystal panel are supplied from a power supply circuit 4 to the row electrode drive circuit 2, together with a voltage being necessary for operating the row electrode drive circuit 2. The voltages ±V2 (the display voltage) required to drive the column electrodes of the liquid crystal panel is supplied from the power supply circuit 4 to the column electrode drive circuit 3, together with a voltage being necessary for operating the column electrode drive circuit 3.

Control circuit 5 supplies signals to the row electrode drive circuit 2 and the column electrode drive circuit 3 according to information sent from a display data generating source 7. The row electrode drive circuit 2 and the column electrode drive circuit 3 supply scanning signals which are formed by the voltages ±V1 and ±V3, and display signals which are formed by the voltages ±V2, based on the given signals.

Temperature compensation means 6 detects the temperature of the liquid crystal panel 1 or that in the vicinity thereof and to cause at least ±v3, among ±V1, ±V2 and ±V3, to change according to a result of the detection, so that the following equation always holds: |V3|=|Vh| (the optimum holding voltage).

FIG. 6(*b*) illustrates the case that the voltage |V3| which is the scanning-signal-voltage in the holding period tk is changed according to temperature by the temperature compensation means, whose configuration is illustrated in FIG. 6(*a*). The voltage V3 drops its potential with rise of temperature. The voltage (−V3) rises its potential with increase in temperature. Thus, the temperature compensation is performed so that the voltage |V3| becomes equal to the optimum holding voltage |Vh|, which is obtained as illustrated in FIG. 5, at any temperature.

If the temperature compensation is performed on the voltage |V3| in this manner, the mean value of the optical transmittance can be maintained at a constant value in the holding period tk at any temperature. Thereby, the reduction in contrast, as well as the deterioration in linearity of the gray shades display, can be prevented.

Figure 7:
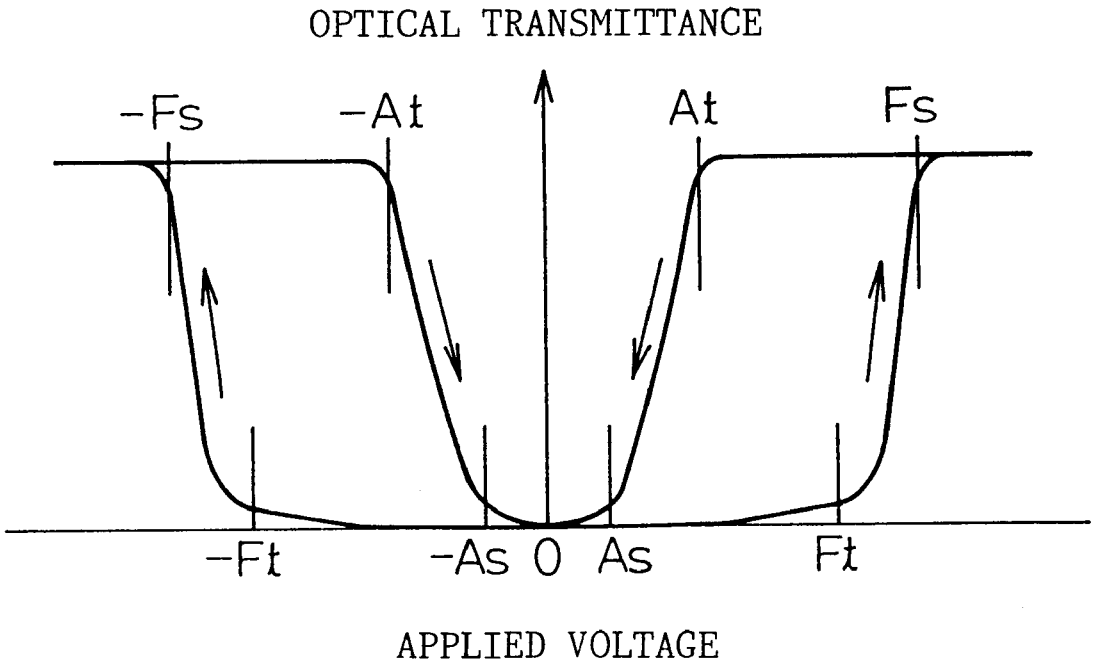
FIG. 7 is a diagram illustrating a change in the optical transmittance of an antiferroelectric liquid crystal panel versus a voltage applied thereto.

It is known that the hysteresis characteristics of FIG. 7 described above vary with temperature in the antiferroelectric liquid crystal panel. Hence, it is considered that the temperature compensation is performed on the voltages |V1| and |V2| simultaneously with the temperature compensation to be performed on the voltage |V3|. FIG. 6(*c*) illustrates an example of the case that the temperature compensation is performed on the voltages |V3| together with voltage |V2|. Further, FIG. 6(*d*) illustrates an example of the case that the temperature compensation is performed on the voltages |V3| together with the voltage |V1| and |V2|. Incidentally, regarding pairs of the voltages V1 and (−V1), the voltages V2 and (−V2) and the voltages v3 and (−V3), the voltages of each of such pairs are different only in that the polarities thereof are opposite to each other. Therefore, for simplicity of drawing, only curves respectively representing the voltages (−V1), (−V2) and (−V3) are plotted.

The characteristics shown in FIGS. 6(*b*) to 6(*d*) are not fixed. If a liquid crystal panel having different characteristics is used, the optimum value of the voltage corresponding to each temperature is changed. Thus, it is natural that the individual optimum value of the voltage corresponding to each temperature is changed to a different value and that the relative relation between the optimum voltage value and temperature is also changed to a different relation. Needless to say, an optimum temperature compensation, which is best-suited to the characteristics of the liquid crystal panel, is performed.

Hereinafter, a supplementary explanation will be made. Referring to FIGS. 2(*b*) or 3(*a*), it seems that a change in optical transmittance includes two kinds of response to an abrupt change in an applied voltage in the holding period tk. One is the optical transmittance's quick response (hereunder referred to as a "fast response") to the change in voltage, and the other of which is the optical transmittance's relatively slow response (hereunder referred to as a "slow response") to the change in the voltage and that a change in the optical transmittance, which is synthesized from these two kinds of response, is actually observed.

More concretely, for example, in the case of the optical transmittance L50 of FIG. 2(*b*), it can be considered that the fast response is dominant and is mainly observed in the time period tw2. Then, in the holding period tk, the fast response is first observed in each change of the display signal voltage. Subsequently, the slow response is observed.

Referring to FIG. 11(*b*) based on such an idea, it can be considered that a fast response to a change in the applied voltage from 0 to Vx is mainly observed in the time period Wt in FIG. 11(*b*), that immediately after this time period Wt, another fast response to a change in the applied voltage from Vx to Vz is mainly observed and that thereafter, a slow response represented by a curve, whose gradient corresponds to the applied voltage Vz, is observed. Further, according to FIG. 11(*c*), the fast response is observed in this liquid crystal panel only when the liquid crystals are not completely or not all put in the ferroelectric state. Namely, when the liquid crystals are complete bright state, no fast response has been observed.

Based on such results of the observation, the method of setting each driving voltage according to the hysteresis characteristics obtained by the aforementioned time fixation method 1 is reconsidered. As a result, the following problems are found:

(1) Even if a voltage, by which a halftone gray scale is displayed, is applied in the period tw2, the optical transmittance's fast response is caused just when such a voltage is changed to the holding voltage at the start time of the holding period tk. As a result, an intended gray shades display cannot be held or maintained.

(2) Even if desired optical transmittance is obtained at the start time of the holding period tk, the optical transmittance's slow response is caused when a scanning voltage to be applied in the holding period tk is not suitable. Consequently, an intended gray shades display cannot be achieved.

Thus, the inventor of the present invention has obtained a hysteresis curve, which is useful for setting each driving voltage, by the following method (the time fixation method 2) even when performing a gray shades display.

Incidentally, let Pt and Wt denote the length of one frame and the time period during which the selection voltage is applied, respectively.

(1) The optimum holding voltage |Vh| is obtain by the method illustrated in FIG. 11 which has been described above.

(2) A pulse voltage, which has a duration Wt and a voltage value Vx, is applied to a liquid crystal that has been in a stable antiferroelectric state. Thereafter, the optimum holding voltage |Vh| is applied thereto in the time period (Pt−Wt). Then, the relation between the values of the optical transmittance and Vx is plotted at the end of one flame Pt. This operation is repeated by changing the value of Vx. Thus, a new curve, which passes through the point Ft from the point O and reaches the point Fs in FIG. 7, and another new curve, which passes through the point (−Ft) from the point O and reaches the point (−Fs) in FIG. 7, are obtained.

(3) A curve, which reaches the point O through the point At from the point Fs, and another curve, which reaches the point O through the point (−At) from the point (−Fs), are obtained by performing a method which is similar to the aforementioned time fixation method 1.

Figure 8:
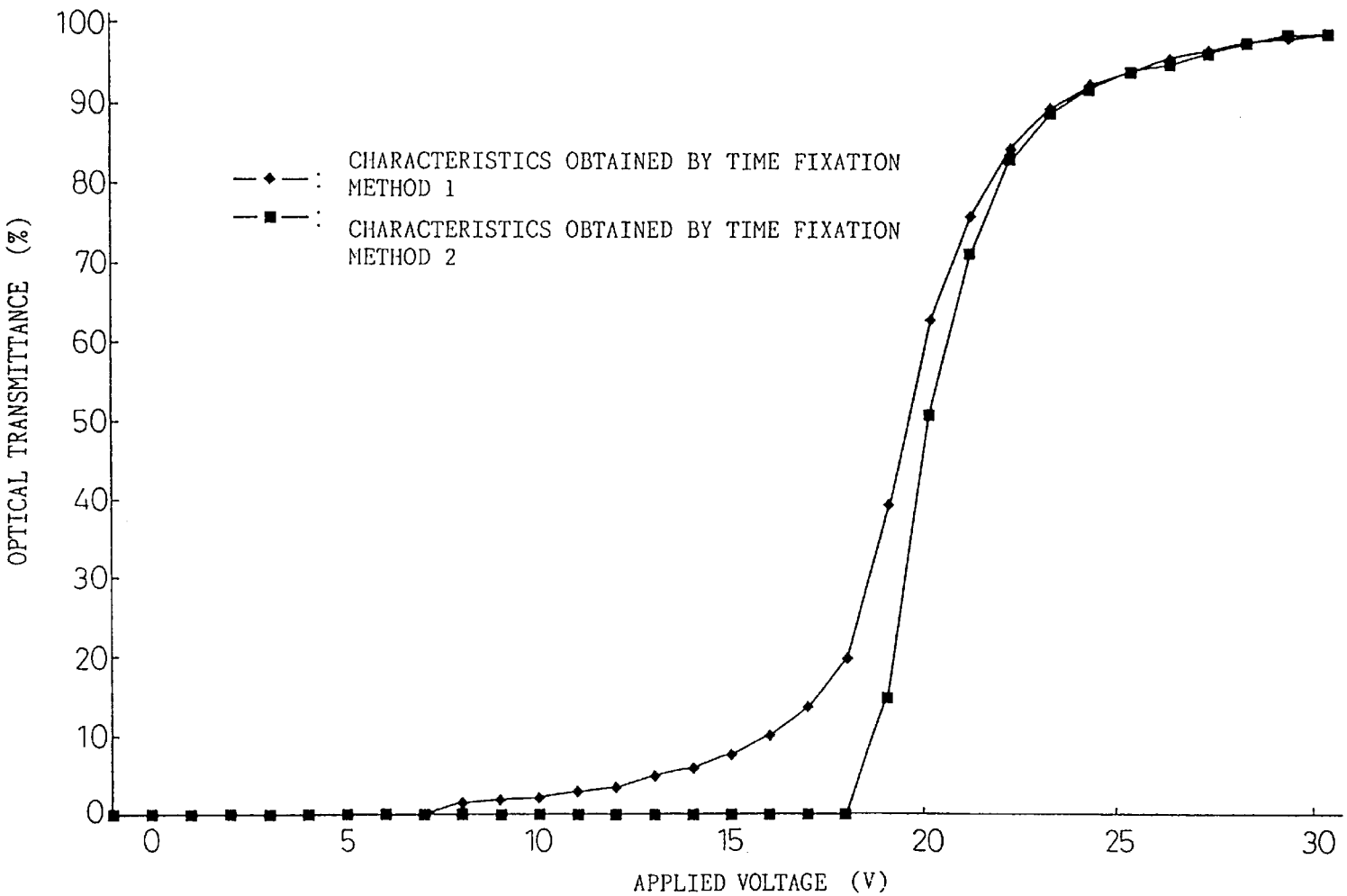
FIG. 8 is a graph showing the optical-transmittance characteristics with respect to the voltage applied to liquid crystals of the antiferroelectric liquid crystal panel in the case of driving the panel by the time fixation method 1 and of driving the panel by the time fixation method 2.
Figure 9:
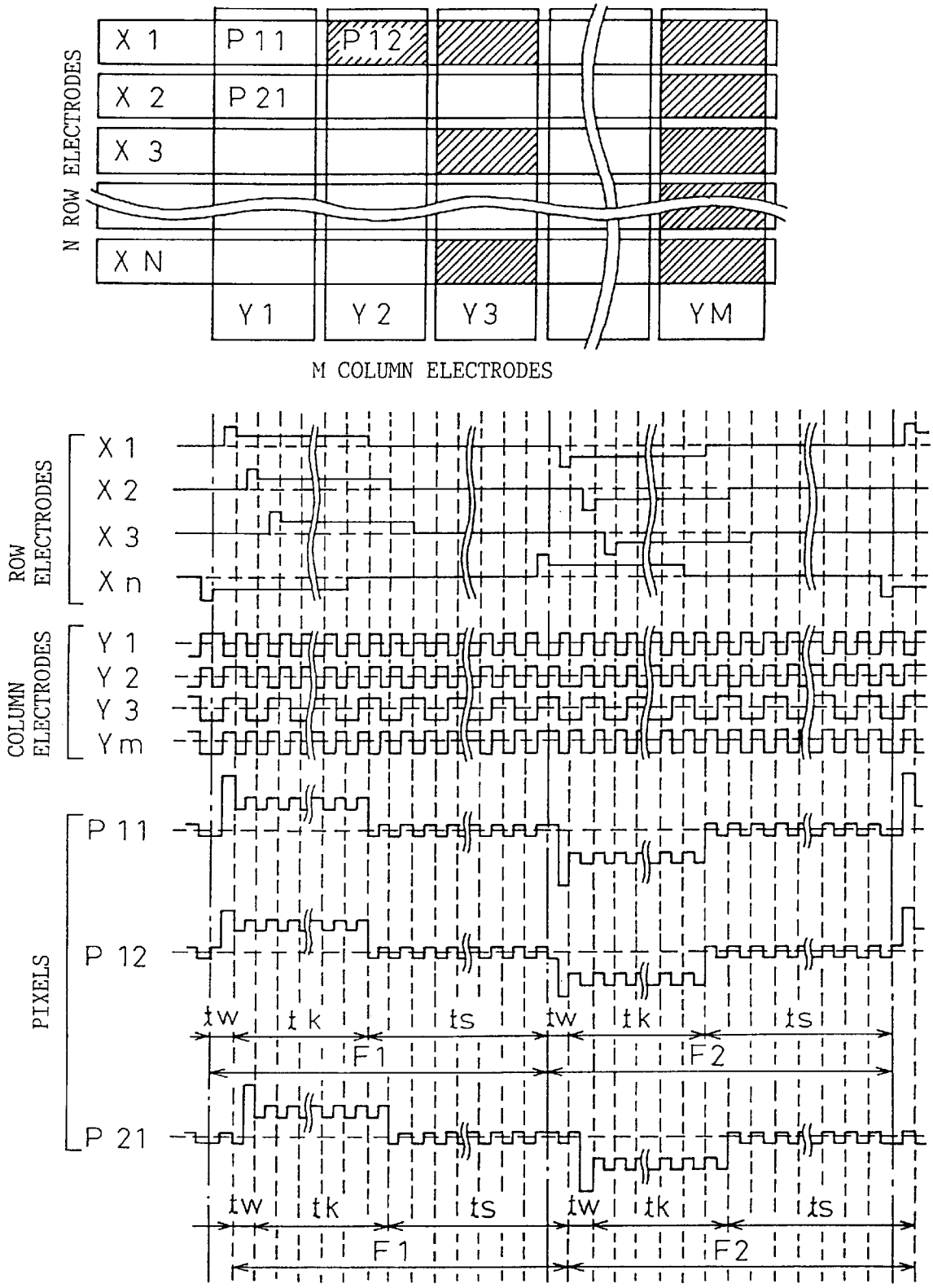
FIG. 9 is a diagram showing waveforms of signals flowing through row electrodes, column electrode and pixel synthesis electrodes of a liquid crystal panel, in which M row electrodes and N column electrodes are placed in a matrix-like configuration.
Figure 10:
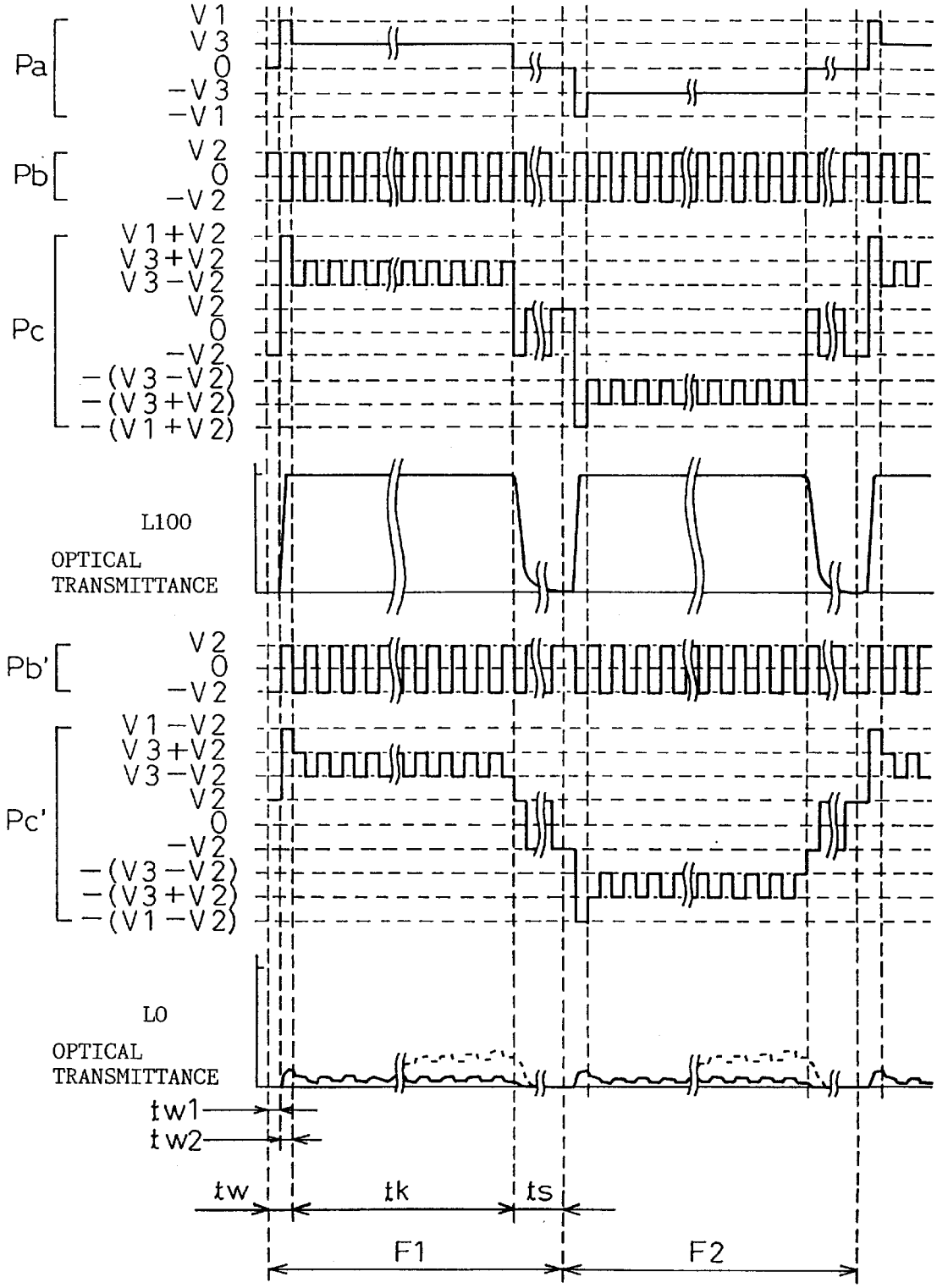
Fig.10 PRIOR ART
FIG. 10 is a diagram showing driving waveforms and optical transmittance in the case of the conventional driving method.

FIG. 8 is a diagram showing a curves, which represents a part from the O point to Fs through Ft on the hysteresis curve of FIG. 7, obtained by the conventional time fixation method 1, and obtained by the time fixation method 2 having the steps (1) and (2) described herein-above, for making a comparison therebetween.

As illustrated in FIG. 8, in the case of the hysteresis curve obtained by the time fixation method 1, the optical transmittance gently rises with increase in the applied voltage. Thus, the value Ft of the applied voltage, at which the optical transmittance steeply rises from 0, cannot be definitely specified or determined.

However, in the case of the hysteresis curve obtained by the time fixation method 2, the optical transmittance abruptly rises. Thus, the value Ft of the applied voltage, at which the optical transmittance abruptly rises from 0, can be definitely determined.

In the case of the conventional hysteresis curve, it is not easy to know the relation between the voltage, which is applied in the time period tw2, and the optical transmittance for a halftone gray shades display. Namely, in the case of the hysteresis curve obtained by the time fixation method 1, the optical transmittance gently rises with an increase in the applied voltage. Thus, the value of the voltage Ft cannot be definitely determined. Further, even if the value Ft is specified, the rise of the optical transmittance is gentle, so that the optical transmittance changes only by a small value in comparison with the optical transmittance when (Ft+Δ) is applied. Consequently, a clear gray shades display cannot be obtained.

In contrast, as a result of employing the hysteresis curve obtained by the aforementioned time fixation method 2, the voltage value represented by the axis of abscissa comes to correspond to the value of the voltage applied in the time period tw2, while the optical transmittance represented by the axis of ordinate comes to correspond to the optical transmittance (exclusive of an amount of a change caused in the relaxation period ts) in one frame. Thereby, when obtaining the linear gray shades display, the axis of ordinate is divided equally. Then, the voltage, which corresponds to the each of optical transmittance, is applied to the liquid crystal in the period tw2. Thereby, the gray shades display is easily achieved. Namely, in the case of the hysteresis curve obtained by the aforementioned time fixation method 2, the optical transmittance abruptly rises from the voltage Ft. Thus, the change in the applied voltage definitely corresponds to the change in the optical transmittance, so that even when the applied voltage changes slightly, the optical transmittance varies distinctly. In other words, to obtain the specific optical transmittance, the applied voltage corresponding to this optical transmittance can be definitely determined. It is necessary for obtaining halftone gray scale levels to set the selection voltage at a value between the values Fs and Ft. In the case of the hysteresis curve obtained by the time fixation method 2, the value Ft of the applied voltage, from which the optical transmittance abruptly rises, is definite. Therefore, the clear gray shades display can be obtained only by slightly changing the value of the selection voltage between the values Ft and Fs. Moreover, because the value Ft can be definitely specified in this case, a value of the optical transmittance, which is distinctly different from the value of the optical transmittance (namely, the dark state) obtained at the value Ft, can be obtained by slightly increasing the value Ft to (Ft+Δ). As above described, the gray shades display can be easily achieved by using the hysteresis curve obtained by the time fixation method 2. Needless to say, there is the necessity of correcting effects obtained in the relaxation period ts.

In the foregoing description of the embodiments, there have been described the driving methods by which the relaxation period ts is set as a time period which is different from the selection time period tw. However, needless to say, other driving methods, such as a method by which the relaxation period ts is established within the selection time period tw, may be employed.

Further, in the foregoing descriptions, it is assumed that each of the aforementioned ferroelectric threshold voltage |Ft|, the aforementioned ferroelectric saturation voltage |Fs|, the aforementioned antiferroelectric threshold voltage |At|, the aforementioned antiferroelectric saturation voltage |As|, the aforementioned optimum holding voltage |Fh| and the amount α of correction have the same value in the (+) ferroelectric side and the (−) ferroelectric side. However, needless to say, if each of these values has different values in the (+) ferroelectric side and the (−) ferroelectric side, the alteration of the voltage having the driving waveform is sometimes needed.

What is claimed is:

1. An antiferroelectric liquid crystal display device having a selection period tw, a holding period tk and a relaxation period ts that is a time period for changing a state of liquid crystals from a ferroelectric state to an antiferroelectric state after the holding period tk and before the selection period tw, wherein a scanning signal voltage in the holding period tk is set at an optimum value by which a mean value of optical transmittance is maintained at a nearly constant value when a display signal voltage applied in the holding period tk is any voltage from 0 to a maximum voltage, inclusive, as an absolute value.

2. The antiferroelectric liquid crystal display device according to claim 1, wherein the value |Vh|, by which the mean value of optical transmittance is maintained at the nearly constant value when the display signal voltage applied in the holding period tk is any voltage from 0 to a maximum voltage, inclusive, as an absolute value, of the scanning signal voltage in the holding period tk meets the following condition: |At|<|Vh|<|Ft|.

3. The antiferroelectric liquid crystal display device according to claim 1 or 2, wherein at least the value of the scanning signal voltage in the holding period tk is changed according to a change in temperature.

4. The antiferroelectric liquid crystal display device according to claim 1 or 2, wherein a gray scale is displayed by changing a maximum voltage applied to the liquid crystals in the selection period.

5. The antiferroelectric liquid crystal display device according to claim 1 or 2, wherein a gray scale is displayed by changing a time period during which a maximum voltage is applied to the liquid crystals in the selection period.

6. A method of obtaining an optimum holding voltage |Vh|, which is a scanning signal voltage that causes optical transmittance or a mean value of optical transmittance to be maintained at a nearly constant value in a holding period tk, in an antiferroelectric liquid crystal display device, and Pt being a length of one frame used in said display device and Wt being a length of a time period during which a selection voltage is applied, said method comprises the steps of:

applying a pulse voltage, which has a duration Wt and an arbitrary fixed voltage |Vx| between |Ft| and |Fs|, to liquid crystals that are in an antiferroelectric state;

applying a voltage |Vz|, which is smaller than the voltage |Vx|, upon completion of applying the pulse voltage; and determining the voltage |Vz|, as the optimum holding voltage |Vh|, so that the optical transmittance is maintained at a nearly constant value in a time period (Pt−Wt).

7. A method of obtaining an optical transmittance curve with respect to an applied voltage in an antiferroelectric liquid crystal display device, and Pt being a length of one frame used in said display device and Wt being a length of a time period during which a selection voltage is applied, said method comprising the steps of:

(1) applying a pulse voltage, which has a duration Wt and a voltage Vx, to liquid crystals that are in a stable antiferroelectric state, thereafter applying an optimum holding voltage |Vh| to the liquid crystals in a time period (Pt−Wt) so that the optical transmittance is maintained at a nearly constant value, changing the voltage Vx and obtaining optical transmittance corresponding to a value of the voltage Vx at a time of expiration of one frame, and obtaining a curve, which represents the optical transmittance as the voltage Vx changes from 0 to Fs through Ft, and another curve that represents the optical transmittance as the voltage Vx changes from 0 to (−Fs) through (−Ft); and (2) next applying a voltage, which is not less than a value |Fs|, to the liquid crystals, thus putting the liquid crystals into a saturated ferroelectric state, setting the applied voltage at a reduced value |Vz| at a moment 0, obtaining a nearly-constant value of optical transmittance corresponding to the value |Vz| after the expiration of a relaxation period by changing the value |Vz|, and obtaining a curve, which represents the optical transmittance as the voltage changes from Fs to 0 through At and As, and another curve that represents the optical transmittance as the voltage changes from (−Fs) to 0 through (−At) and (−As).

* * * * *